US010297944B2

(12) United States Patent
Simmonds

(10) Patent No.: US 10,297,944 B2
(45) Date of Patent: May 21, 2019

(54) SINGLE POLE CONNECTOR

(71) Applicant: Simon Simmonds, San Diego, CA (US)

(72) Inventor: Simon Simmonds, San Diego, CA (US)

( * ) Notice: Subject to any disclaimer, the term of this patent is extended or adjusted under 35 U.S.C. 154(b) by 0 days.

(21) Appl. No.: 15/925,430

(22) Filed: Mar. 19, 2018

(65) Prior Publication Data

US 2018/0269615 A1 Sep. 20, 2018

Related U.S. Application Data

(60) Provisional application No. 62/472,937, filed on Mar. 17, 2017.

(51) Int. Cl.

| | |
|---|---|
| ***H01R 4/70*** | (2006.01) |
| ***H01R 9/05*** | (2006.01) |
| ***H01R 13/56*** | (2006.01) |
| ***H01R 101/00*** | (2006.01) |
| ***H01R 13/426*** | (2006.01) |

(52) U.S. Cl.

CPC ..... *H01R 13/426* (2013.01); *H01R 4/70* (2013.01); *H01R 9/0521* (2013.01); *H01R 13/562* (2013.01); *H01R 2101/00* (2013.01)

(58) Field of Classification Search

CPC .... H01R 13/562; H01R 13/56; H01R 13/565; H01R 13/5841; H01R 13/53; H01R 13/426; H01R 4/70; H01R 9/0521; H01R 2101/00

USPC ..... 439/445–448, 628, 866, 877, 879

See application file for complete search history.

(56) References Cited

U.S. PATENT DOCUMENTS

| | | | | |
|---|---|---|---|---|
| 3,487,160 | A * | 12/1969 | Johnsen | H02G 15/08 174/76 |
| 3,720,906 | A * | 3/1973 | Punako | F16G 11/048 439/445 |
| 3,786,397 | A * | 1/1974 | Bridges | H02G 15/06 439/277 |
| 5,018,987 | A * | 5/1991 | Kirma | H02G 3/0691 439/445 |
| 5,380,224 | A * | 1/1995 | DiCicco | H01R 4/70 439/447 |
| 6,514,095 | B1 * | 2/2003 | Smith | H05K 5/068 439/306 |
| 7,544,085 | B2 * | 6/2009 | Baldwin | H01R 13/5829 439/446 |
| 7,837,495 | B2 * | 11/2010 | Baldwin | H01R 13/5804 439/446 |
| 2006/0169473 | A1 * | 8/2006 | Dobler | H01R 13/562 174/73.1 |
| 2015/0111420 | A1 * | 4/2015 | Zillinger | E21B 43/123 439/521 |
| 2017/0025788 | A1 * | 1/2017 | Lindkamp | H01R 13/5205 |
| 2017/0062984 | A1 * | 3/2017 | Moseke | H01R 13/6272 |
| 2018/0019550 | A1 * | 1/2018 | Simmonds | H01R 9/0524 |

* cited by examiner

*Primary Examiner* — Gary F Paumen

(74) *Attorney, Agent, or Firm* — Donn K. Harms

(57) ABSTRACT

A male electric connector engaged with a cable carrying electric current. The connector is formed of a plug having a center conductor at said first end engaged to one end of a cable running axially through the plug and exiting the plug at a second end. A conductive annular ring is connected with a conductive member extending from the ring to a second end having a first connector thereon. Any of a plurality of secondary support members having a second connector thereon engageable to the first connector, may be engaged to the plug to support the cable and prevent bending.

12 Claims, 3 Drawing Sheets

SINGLE POLE CONNECTOR

This application claims priority to U.S. Provisional Patent Application Ser. No. 62/472,937, filed on Mar. 17, 2017, which is incorporated herein in its entirety by this reference thereto.

BACKGROUND OF THE INVENTION

1. Field of the Invention

The present invention relates generally to single pole connectors employed in electrical systems carrying electricity at high amperage. More particularly, the invention relates to an improved connector having an annular aluminum member extending through the plug body in electrical communication with an annular engagement threaded portion which protrudes from the insulation. The exposed threaded portion is adapted to allow threaded engagement with and to therefor utilize, any one of a plurality of different strain relief components which support and impart significant reduction of strain on the heavy cabling once engaged. Thus the device may be engaged with a strain relief component adapted to the task and additionally has enhanced shielding from the annular aluminum member.

2. Prior Art

Single pole cable connectors which are positioned at the terminating ends of large electric cables used to communicate high amperage electrical power requirements are used in a variety of commercial settings. Such include cabling for power delivery to components of oil and other drilling platforms, power systems for concerts and large gatherings requiring high amperage power, and other electric equipment where operational components have high power requirements such as carnival rides and the like. Because of the requirements of the electric motors, lights, and high power electric equipment to which high amperage power is delivered using insulated flexible cables, the conductive connectors positioned on terminating ends of these power transmission cables and upon female receptacles for the cable connectors, are rated and constructed for extremely high voltage and current carrying capacity.

However, while current complimentary connections between male and female fittings of such high power transmission lines has standardized to provide covered and insulated connectors adapted for complimentary engagement of cable ends, such mating connections conventionally continue to suffer from a number of issues.

A significant problem with such high power cabling and the conductive connectors employed therewith, is the strain imparted to the connector in the mating of the conductive cable to the connector. Such stress communicates thereto by the sheer weight of the cabling and insulation terminating at a conventional male connector as well as bends and pulls on the cable of such engaged connectors.

The terminating male connectors conventionally employed with a thick conductive cable and significant layer of insulation placed thereof as required for transmission lines carrying electricity at high amperage and voltage, are conventionally placed in a compressive engagement with a conductive collar engaged with the conductive male connector. The male connector is engaged in an as-used configuration electrically connected and frictionally engaged within a complimentary receptacle during use.

In this as-used positioning, the cable and insulation terminating at the male connector engaged with a receptacle, projects from the rear of the male connector along an axis of the receptacle in which the male connector engages. This axis is conventionally horizontally disposed, and thus, the cabling from a male connector extends away from the connector horizontally. It being otherwise unsupported, the extending cable must flex and curve for a length until it is supported on the ground or the support surface for the housing in which the one or a plurality of receptacles for the male connectors are engaged on a buss.

As noted, the thick conductive cable, such as solid or stranded copper or the like, surrounded by a thick coating of a dielectric material insulation in such high power transmission lines, forms an electrical cable which has a weight which is heavy by nature. Because the cable and insulation engaged to and extending from a male connector is conventionally unsupported, it tends from weight and gravity to assume a curved configuration. Such occurs in a short period of time, when the path of the cable requires it to drop from an elevated connection, to the floor, ground, or a support surface.

Over time, the continued stress imparted to the cable and insulation while formed to this curved configuration extending from the rear of the male connector engaged with a receptacle, can inevitably cause damage to the connection between the male connector and cable within the insulation. Further, the force of the curved configuration and heavy weight, can also over stress the flexible insulation surrounding the high power conducting cable and cause cracking or peeling thereof which is dangerous should the underlying conductive cable become exposed.

Damage to either the insulation, or the connection between the power-carrying conductive cable and male connector, from an ongoing curved and stressed configuration of the cable and insulation exiting the male connector, can easily be the source of serious problems such as overheating, fires, electric shocks, and other dangerous problems.

The device herein shown and disclosed provides an improved high amperage cable connector device configuration, which remedies the noted issues widely present with high amperage and other electric cabling, where patch and connective cables extend from male connectors in high power systems. The device herein is employable with any of the current high power cable connection systems currently in use without need for modification to encourage widespread use for safety sake. It is configured to allow a user to removably engage a support or cable stress reliever of choice, using a threaded or otherwise complimentary connector engagement which also provides a ground. Users, thus, can choose and engage the cable support and stress reducer of choice for a particular installation and thereby provide sufficient support to the cable exiting male connectors and the connection of the conductive cable connection to eliminate the current problems caused by long term weighted stressed connections.

The forgoing examples of related art as to high amperage cabling, cabling connections, dangerous conditions caused by conventional unsupported stressed engagements with male connectors, and limitations related therewith, are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provide solutions to the shortcomings in prior art with regard to single pole heavy duty cabling and the like and the problems caused by the insecure engagement between male connectors and the terminating end of the conductive wires, as well as the surrounding insulation thereto. The device and modes thereof herein provide structural support for the exiting cable and insulation from male single pole connectors which is easily incorporated into the installed base of such single pole connectors and receptacles. By providing a solution to the unsupported nature of male single pole connectors, the device in all modes herein can be quickly employed in widespread use with no alteration to the existing receptacles for such high current cabling.

In a particularly preferred mode of the device herein, in all configurations, an insulated molded connector such as one surrounded by rubber, neoprene, or an appropriate dielectric insulation material has an annular aluminum member positioned therein and running through cable insulation from the plug body, to a mating connecter such as the shown protruding annular threaded member. The annular threaded member, as well as the elongated aluminum member, are grounded to the cable plug and may be formed as shown as a unitary structure, or assembled to one from multiple components.

The annular member runs coaxial to the conductive cable running through the axis of the cable, and thus, surrounds a portion of the conductive cable extending from the plug. A mating connector is positioned at a distal end of the conductive cable which is configured for operative connection with a connector positioned an any one of a plurality of different secondary support members or strain relievers which can be engaged to and about the exterior of the cable. Currently, threads are shown on the mating connector at the distal end of the annular member which will threadably engage with a mating connecter on the chosen secondary support member forming the strain reliever. However, other mating connecters such as a bayonet type mount, spring loaded mounts, slots and projections twisting engageable connectors, or any pair of mating connectors as one skilled in the art would employ from the 2018 GRAINGER catalog or similar catalogs of mating fasteners and connectors.

As noted, a first mating connector on the distal end of the annular member opposite the end adjacent the plug is configured to removably engage with a second mating connector located on a strain relief component adapted to the task of supporting the connected cable. A certain mode of strain relief maybe selected for varying reasons, strain relief, regulatory approval and acceptance, space constraints and/or cost ramifications.

In this fashion, one plug body adapted to engage and form an electrical connection with a socket to an energized electrical conductor within an insulated covering, with the disclosed annular aluminum member and accessory connector at a distal end such as threads, provides a uniform platform for engagement of any of a plurality of strain relief components having a mating connector thereon. Additionally provided are the ability to ground the engaged support as well as RF shielding.

It should be noted that the secondary members providing strain relief engageable to a cable having the annular member and mating connector herein, are exemplar and should in no fashion be considered limiting. It is highly likely that new supports will be developed in addition to conventional supports, because of the ability the novel grounded mating connector provided at the distal end of the annular aluminum member affords. As such, any supporting member or component, which has a mating connector thereon adapted for removable engagement to the mating connector at the distal end of an annular member extending from a plug, is considered within the scope of this patent.

Such secondary members or strain relief components which are known to those in the art and would be fitted with a mating connector enabling removable engagement include for example a woven grip, a cable gland, a mechanical clamp, a compression nut, support members engageable to support points, or other cable supports which are or have been employed with electrical connectors and in fixed installations. Further, the device herein may be employed with any number of strain relief components which may be selected for varying reasons, such as a specific type of strain relief, regulatory approval and acceptance, space constraints and/or cost ramifications.

As shown, the device herein in all modes includes an annular aluminum member which extends away from a recessed connecting ring in a direction away from a rear side of the male connector. In this configuration, the axial passage in the annular member surrounds the conducting cable and insulation. This annular member is sandwiched in position within the insulation surrounding the circumference of the conducting cable.

Extending from the male connector in this fashion the annular member itself is configured and positioned to provide a first length of support to the conducting cable and surrounding insulation running coaxially within the axial chamber of the annular member. So supported by the metal of the annular member, the conducting cable and insulation are prevented from assuming a curved configuration immediately adjacent to the male connector, which has shown to cause fractures in the crimped connection of the cable and connector as well as cracks in the insulation.

In other preferred modes, as noted, at a second end of this annular member a first mating connector such as an annular threaded portion is positioned and uncovered by the insulation which is sandwiched around the rest of the annular member extending from the mounting/grounding ring. To this first mating connector, as noted, any number of support components are engageable so long as they include a matching or complimentary second mating connector to that on the distal end of the annular member. Such includes clamps, woven supports formed to surround and contact the exterior of the insulation covering the conductive cable enclosed within the grip of the weave, and/or a cable gland connected with a compression nut.

With respect to the above description, before explaining at least one preferred embodiment of the herein disclosed boot configuration for a single pole male connector in detail, it is to be understood that the connector for high amperage electric system invention herein is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed electrical connector system and method. It is important, therefore, that the claims be regarded as including such equivalent construction and methodology insofar as they do not depart from the spirit and scope of the present invention.

The objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

Figure 4:
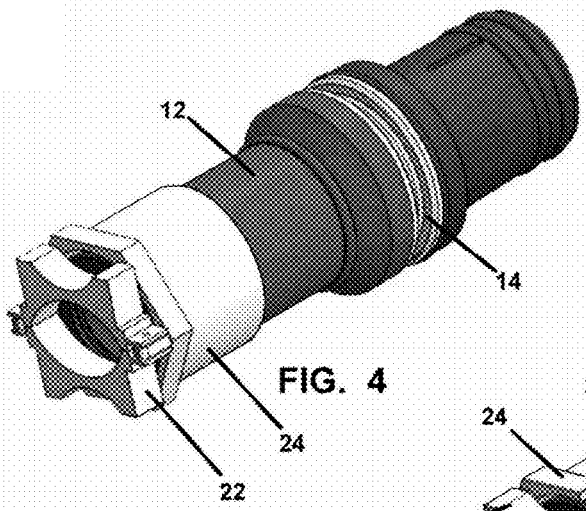

FIG. 4 shows a depiction of one preferred secondary support component in the form of a mechanical clamp sized to grip the exterior of the insulation surrounding the conducting cable and having a second mating connector configured to removably engage the first mating connector on the distal end of the annular member, where the clamp is engageable to a nut having an open end having threads therein forming the complimentary connecter to those on the second end of the annular member.

Figure 5:
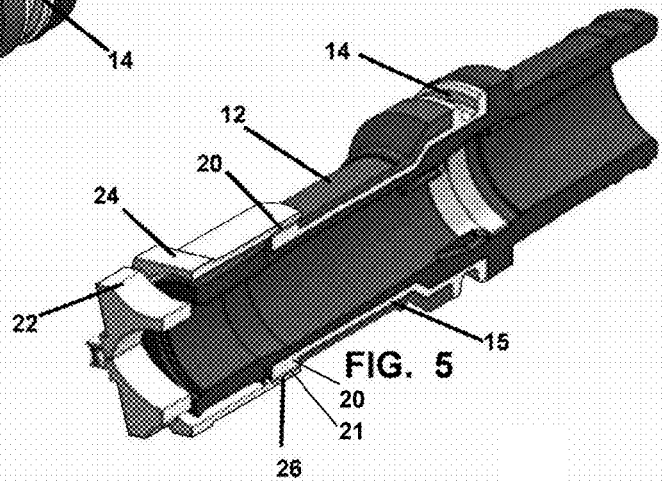

FIG. 5 shows sectional view through FIG. 4 showing the first end of the clamp having the second mating connector thereon removably engaged to the first mating connector at the distal end of the annular member.

Figure 6:
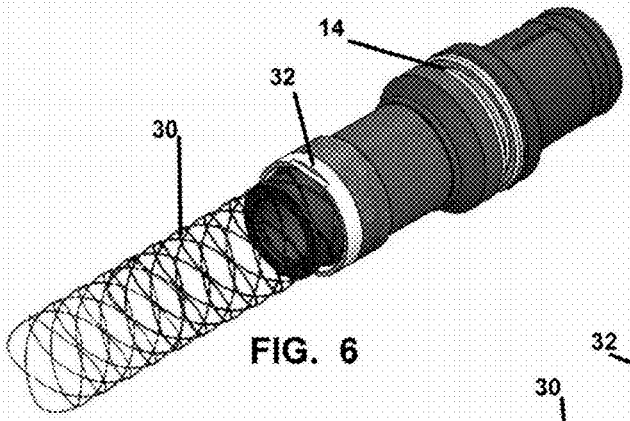

FIG. 6 depicts a perspective view of a woven support formed to surround and contact the exterior of the insulation covering the conductive cable and having the second mating connector positioned at a first end thereof which is removably engageable with the first mating connector, shown as but not limited to threads, on the distal end of the annular member.

Figure 7:
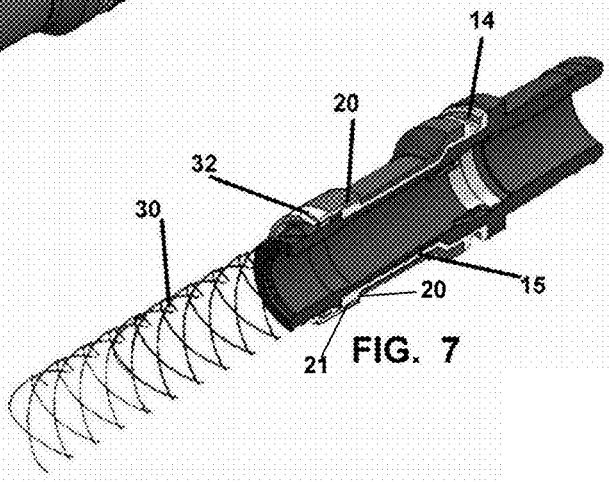

FIG. 7 is a sectional view through FIG. 6 showing the elongated annular member in a grounded connection at a first end with the socket, and extending to a distal end with the first mating connector engaged to the second mating connecter of the woven support.

Figure 8:
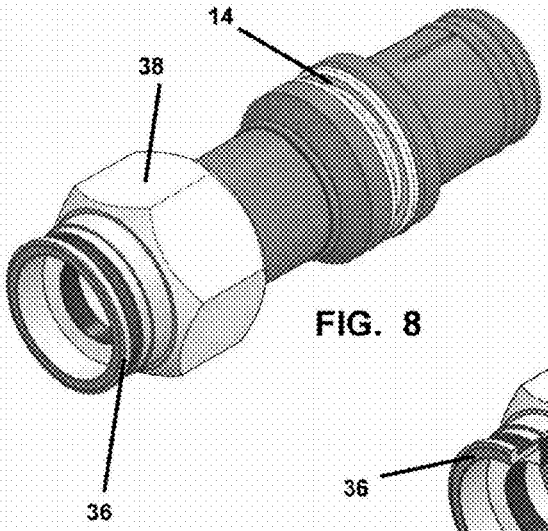

FIG. 8 depicts a perspective view of the device having a cable gland connected with a compression nut which is configured at first end with the second mating connector configured to engage the first mating connector shown as threads on the distal end of the annular member extending from the male connector.

Figure 9:
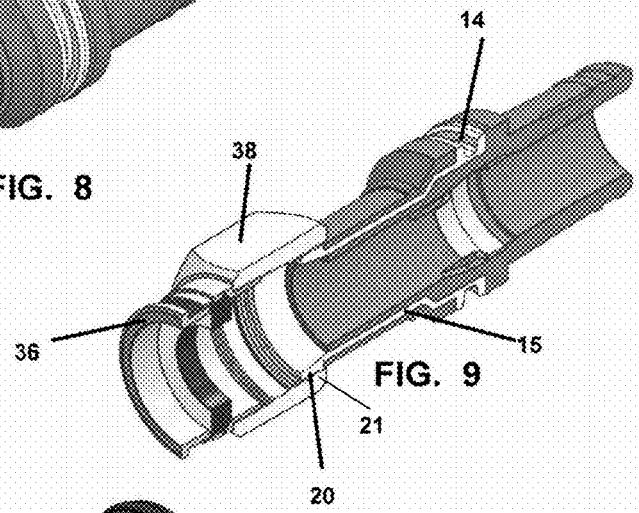

FIG. 9 depicts a sectional view through FIG. 8.

Figure 10:
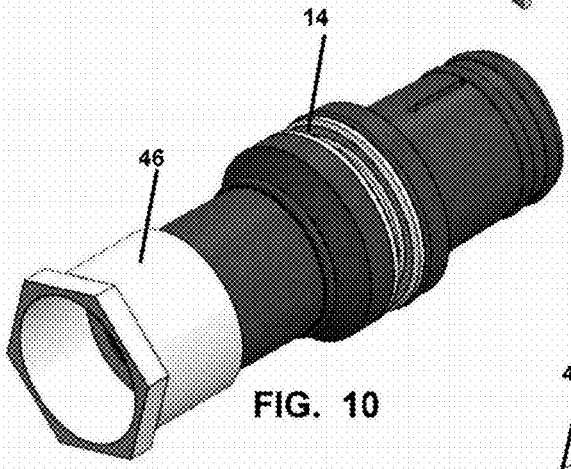

FIG. 10 shows a perspective view of the device showing a compression rubber and clamp having the second mating connector at one end which removably engages the first mating connector shown as but not limited to threads, located at the distal end of the annular support.

Figure 11:
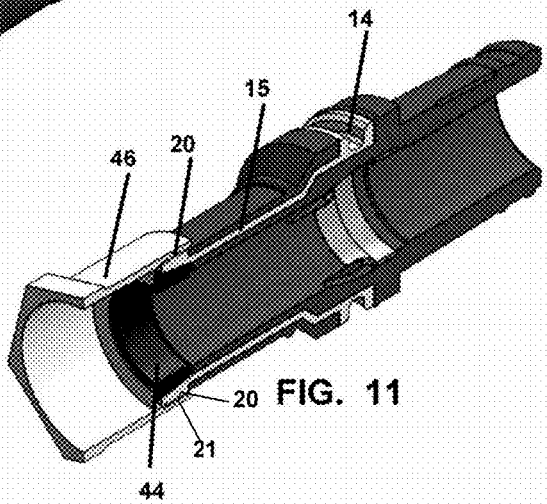

FIG. 11 is a sectional view of FIG. 10.

Other aspects of the present invention shall be more readily understood when considered in conjunction with the accompanying drawings, and the following detailed description, neither of which should be considered limiting.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 1:
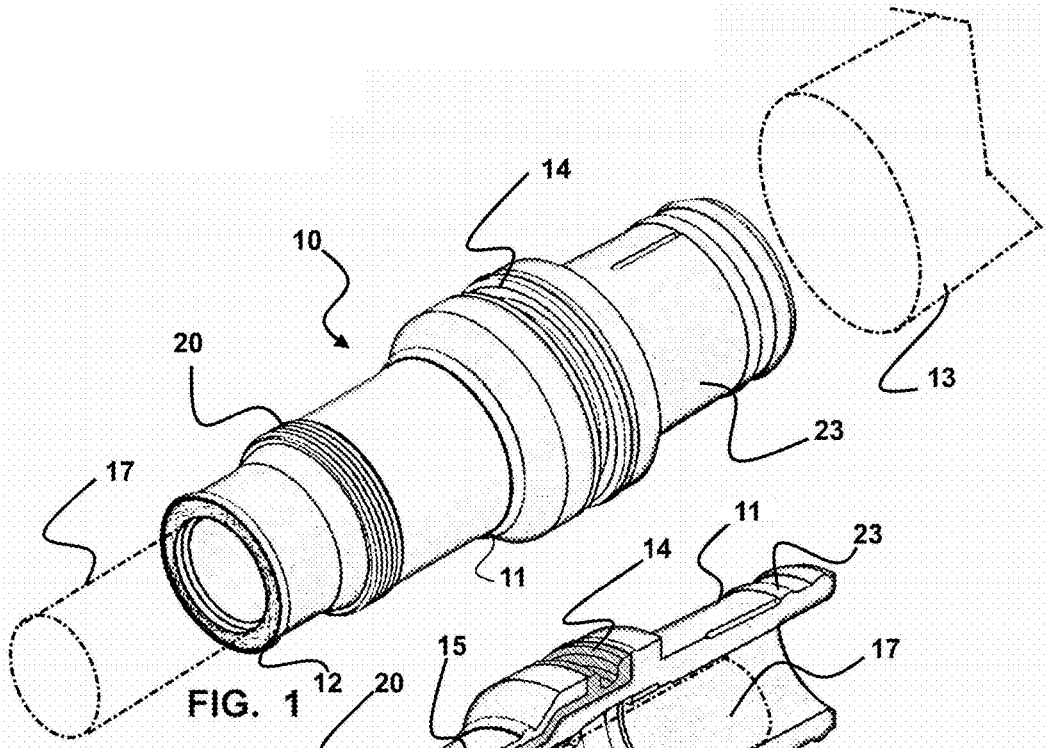
FIG. 1 depicts a perspective view of the preferred mode of the device herein for a male connector showing the exterior of the insulating layer surrounding the conductive cable and connecter and showing the complimentary first mating connector extending from the insulation positioned to engage a second mating connector on a support component.

Now referring to drawings in FIGS. 1-11, wherein similar components are identified by like reference numerals, there can be seen in FIG. 1, a particularly preferred mode of the plug device 10 herein and the configuration employed in all modes herein. The plug 11 in all modes shown herein, is adapted to engage with a receptacle 13 to communicate electric power through a conductive center conductor 23 in electrical communication with a conductive cable 17 such as a copper solid or braided cable 17.

The plug 11 is configured with a surrounding insulating boot for the shown male single pole center conductor 23, which is adapted for insulated communication of high voltage and/or amperage electric current from the receptacle 13 when engaged therein. In such an engagement, the center conductor 23 contacts an internal collar in the receptacle 13 carrying the electric current and an annular grounding ring 14 operatively connects with a ground in a well known connection.

The plug 11 of the device 10 has an exterior insulating layer 12 covering the conductive cable 17 running axially through the interior. The connective annular grounding ring 14 is shown which is generally engaged with a pin to secure the plug 11 into operative engagement with a receptacle 13 with the connective annular grounding ring 14 electrically grounded thereby.

Figure 2:
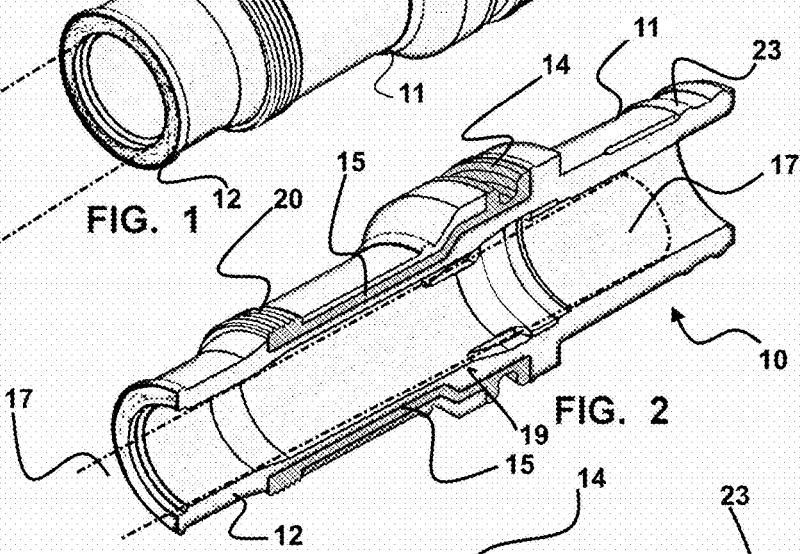
FIG. 2 shows an sectional view of the device in FIG. 1 showing the annular imbedded in the insulation layer extending from a first end adapted to engage with a receptacle and to ground the annular member in such an engagement, to the distal end having the first mating connector thereon.
Figure 3:
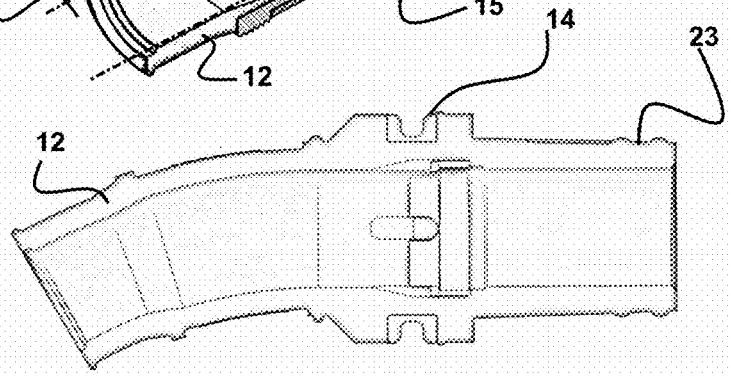
FIG. 3 (Prior Art)
FIG. 3 shows is a prior art depiction of a conventional male connector engaged with and extending from a receptacle for the male connector, showing no annular member and a resulting curved configuration caused by the weight of the extending cable especially over time.

In the device 10 herein, as more clearly shown in FIG. 2, an elongated or tubular or annular conductive member such as an annular member 15, extends from engagement with or part of the annular grounding ring 14, in between the exterior insulating layer 12 and an interior insulating layer 19 (FIG. 2) toward a rear of the plug 11 of the device 10 wherein the insulated cable 17 exits.

As can be seen in FIG. 2, an axial passage running through the annular member 15 surrounds a secondary or interior layer of insulation 19 and runs coaxial to or surrounds the conducting cable 17. As shown in all modes of the device 10, the annular member 15 extends from and is in an electrical engagement with the annular grounding ring 14 and may be molded or manufactured in a sandwiched position within the first or exterior layer of insulation 12 and the secondary layer of insulation 19 surrounding the circumference of the conducting cable 17. The annular member 15 and annular grounding ring 14 may be formed as a single part or may be electrically engaged during manufacture.

The annular member 15, extending from the ring 14 of the male plug 11 in this fashion, provides a first support to the conducting cable 17 and surrounding insulation 19 for that cable 17 which runs through an elongated chamber of the annular member 15. With this first means for support from the annular member 15, the conducting cable 17 and secondary insulation 19 surrounding it, are prevented from assuming a curved configuration shown in FIG. 3, at a position immediately adjacent the annular grounding ring 14 such as with conventional plug 11 connectors which causes fractures in the crimped connection of the conductive cable 17 to the metal center conductor 23 as well as cracks in the insulation 19 and 12.

While the annular member 15 can provide this support by simply extending a distance away from the annular grounding ring 14 while surrounding the cable 17, the configuration of the plug 11 herein, provides additional utility to the user, to connect any secondary support member to the plug 11 which will engage to a first connector 20 shown as a threaded portion using a second connector 21 located on the secondary support member. The positioning of a grounded first connector 20 engaged with the distal end of the rigid annular member 15, allows the user to choose any such secondary support member having this second connector 21 to engage the first connector 20, and thereby achieve a strong connection of the secondary support member to the plug 11, which is also grounded as it is in electrical contact with the annular grounding ring 14 which as noted is grounded when engaged with a mating receptacle 13 for the plug 11.

While the first connector 20 is shown as an annular threaded portion, and as in other modes this first connector 20 can be any removably engageable connection between a first connector 20 configured to removably engage the second connector 21 such as twist locks, bayonet mounts, or other such removable engagements as one skilled in the art would employ.

In FIGS. 4-5 a first preferred secondary support member is shown and includes a mechanical clamp 22 sized to grip the exterior of the secondary insulation 19 surrounding the conducting cable 17 shown earlier. This clamp 22 can be engaged, or be engageable to a nut 24 having the second mating connector 21 which engages the first connector 20 such as threads. With the nut 24 engaged to the threaded portion 20, the clamp 22 can provide extra support to the cable 17 from curving or when pulled upon.

Shown in FIGS. 6-7, a mesh or woven secondary support member 30 can be employed to support the cable 17. This secondary support member 30 has the mating second connector 21 at a first end adapted to removably engage the first connector 20 at the distal end of the elongated annular member 15. While, as noted, any first connector 20 removably engageable to the second connector 21 may be employed which will hold the secondary support 30 to the distal end of the rigid annular member 15, currently threads on a first connector 20 which mate with threads on the second connector 21 are a favorite mode as they are easy to engage and stay connected.

The woven secondary support member 30 of FIGS. 6-7 is sized to surround and contact the exterior of the secondary insulation 19 covering the conductive cable exiting the rear of the boot device 10. A first end of the woven secondary support member 30 is adapted for engagement to the first connector 20 using a connective nut 32 having the second connector 21 therein. As shown, but not limiting, threads are shown as the first and second mating connectors. The woven secondary support member 30 in contact with the circumference of the cable 17 insulation, much like a "Chinese puzzle" provides excellent strain relief and protection from lateral forces and extra support to prevent the bend shown in FIG. 3.

Depicted in FIGS. 8-9 is another engageable secondary support member shown including a cable gland 36 operatively connected to a compression nut 38. The nut 38 is configured at a first end with a second connector 21 complimentary to and removably engageable to the first connector 20 such as the depicted threads on both. At an opposite end from the engagement with the first connector 20, the nut 38 includes a female thread 42 configured for operative threaded engagement with the cable gland 36 thereon. So engaged, the cable gland 36 provides a seal against the ingress of dust and moisture.

In yet another mode of the device 10 shown in FIGS. 10 and 11, a compression rubber 44 and clamp 46 can be provided as the secondary support member which is engageable with the plug 11. This mode when employed in manufacture of the plug 11 of the device 10 during manufacture, employs the same inner core configuration, and annular member 15 extending from a connection with or as part of the ring 14.

In this mode, a first end of the nut 46 has the second connecter 21 thereon for mating with the first connector 20 on the annular member 15 distal end. The rubber grommet 44 when installed, is then compressed by engagement of the second connector 21 on the nut 46 with the first connector 20 on the annular member 15, and imparts support to the cable 17 extending therethrough. This mode of the device 10 helps increase the strain relief on the cable 17 exiting the rubber isolator boot device 10 to prevent problems associated with such.

It should be noted and anticipated that although the insulating and support system for male connectors engaging power receptacles herein is shown in its most simple form, various components and aspects of the device may be differently shaped or slightly modified when forming the invention herein. As such, those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the connector invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A male connector for engagement to an electric cable, comprising:

a plug having a first end and having a second end;

a center conductor at said first end, said center conductor engaged to one end of a cable running axially through said plug and exiting at said second end;

interior insulation surrounding said cable running through said plug;

an annular ring projecting through an exterior layer of insulation at a position adjacent said first end of said plug;

a conductive member engaged with said annular ring at a first end and extending in between said exterior layer of insulation and said interior layer of insulation to a second end of said member positioned adjacent said second end of said plug;

a first connector engaged projecting through said exterior insulation adjacent said second end of said plug, said first connector engaged with said conductive member; and said first connector removably engageable with a second connector connected with a secondary support, said secondary support engageable with said cable exiting said second end of said plug to prevent bending of said cable.

2. The male connector for engagement to an electric cable of claim 1 additionally comprising:

said conductive member being an annular member surrounding said cable running through said plug; and said first connector being an annular threaded connector configured to engage threads forming said second connector connected to said secondary support.

3. The male connector for engagement to an electric cable of claim 1 additionally comprising:

a ground circuit communicating from said annular ring through said conductive member to said second connector engaged with said first connector.

4. The male connector for engagement to an electric cable of claim 2 additionally comprising:

a ground circuit communicating from said annular ring through said conductive member to said second connector engaged with said first connector.

5. The male connector for engagement to an electric cable of claim 1 additionally comprising:

said secondary support being a woven mesh surrounding a portion of said cable exiting said second end of said plug.

6. The male connector for engagement to an electric cable of claim 2 additionally comprising:

said secondary support being a woven mesh surrounding a portion of said cable exiting said second end of said plug.

7. The male connector for engagement to an electric cable of claim 3 additionally comprising:

said secondary support being a woven mesh surrounding a portion of said cable exiting said second end of said plug.

8. The male connector for engagement to an electric cable of claim 4 additionally comprising:

said secondary support being a woven mesh surrounding a portion of said cable exiting said second end of said plug.

9. The male connector for engagement to an electric cable of claim 1 additionally comprising:

said secondary support being a clamp engaged with a portion of said cable exiting said second end of said plug.

10. The male connector for engagement to an electric cable of claim 2 additionally comprising:

said secondary support being a clamp engaged with a portion of said cable exiting said second end of said plug.

11. The male connector for engagement to an electric cable of claim 3 additionally comprising:

said secondary support being a clamp engaged with a portion of said cable exiting said second end of said plug.

12. The male connector for engagement to an electric cable of claim 4 additionally comprising:

said secondary support being a clamp engaged with a portion of said cable exiting said second end of said plug.

* * * * *